US010081477B2

(12) United States Patent
Panzica et al.

(10) Patent No.: US 10,081,477 B2
(45) **Date of Patent: *Sep. 25, 2018**

(54) METHOD OF PACKAGING A PRODUCT FOR SHIPMENT AND PRODUCT-SHIPPING PACKAGE

(71) Applicant: ORORA NORTH AMERICA, Buena Park, CA (US)

(72) Inventors: Anthony Panzica, Cranbury, NJ (US); Efren Zamora, Cranbury, NJ (US)

(73) Assignee: Orora Packaging Solutions, Buena Park, CA (US)

( * ) Notice: Subject to any disclaimer, the term of this patent is extended or adjusted under 35 U.S.C. 154(b) by 141 days.

This patent is subject to a terminal disclaimer.

(21) Appl. No.: 15/150,347

(22) Filed: May 9, 2016

(65) Prior Publication Data

US 2016/0251139 A1 Sep. 1, 2016

Related U.S. Application Data

(62) Division of application No. 14/313,032, filed on Jun. 24, 2014, now Pat. No. 9,334,092.

(51) Int. Cl.
*B65D 5/00* (2006.01)
*B65D 81/02* (2006.01)
(Continued)

(52) U.S. Cl.
CPC ..... *B65D 81/027* (2013.01); *B65B 5/04* (2013.01); *B65B 11/00* (2013.01); *B65B 11/004* (2013.01);
(Continued)

(58) Field of Classification Search
USPC ..... 206/497, 591, 594, 583, 451, 454, 449
See application file for complete search history.

(56) References Cited

U.S. PATENT DOCUMENTS 3,921,890 A 11/1975 Reihrn
4,008,804 A 2/1977 Poggiali
(Continued)

FOREIGN PATENT DOCUMENTS

CA 2593025 4/2006
KR 20130004390 1/2013

OTHER PUBLICATIONS

Smart Karton, The Boxes, http://www.smartkarton.com/the-smart-karton-boxes/, as archived by the Wayback Machine on Jan. 8, 2014, 2 pages.

(Continued)

*Primary Examiner* — Jacob K Ackun
(74) *Attorney, Agent, or Firm* — Martin & Ferraro, LLP

(57) ABSTRACT

A method for packaging a product and a product-shipping package. A pad includes upper and lower horizontal score lines inset from upper and lower edges, and right and left vertical score lines inset from right and left edges. The score lines define a central portion, upper and lower portions, and right and left portions. The product is placed on the central portion. The upper and lower portions fold toward the central portion, contacting the product. A wrap of restraining material is wrapped around the pad and the product. The right and left portions fold to an upright position perpendicular to the pad. The right and left vertical score lines include die-cut tabs. When the right and left portions fold to the upright position, the die-cut tabs extend to an aligned position below and perpendicular to the pad. The pad and the wrapped product insert into a master shipping container. The wrap holds the product in position on the pad. The upright right and left portions and the extended die-cut tab portions t suspend the pad and product within the container.

9 Claims, 8 Drawing Sheets

(51) Int. Cl.

| | |
|---|---|
| ***B65B 11/48*** | (2006.01) |
| ***B65B 5/04*** | (2006.01) |
| ***B65B 49/00*** | (2006.01) |
| ***B65B 55/20*** | (2006.01) |
| ***B65B 23/00*** | (2006.01) |
| ***B65B 13/00*** | (2006.01) |
| ***B65B 11/00*** | (2006.01) |
| ***B65D 77/04*** | (2006.01) |
| ***B65D 5/50*** | (2006.01) |
| ***B65D 5/42*** | (2006.01) |

(52) U.S. Cl.

CPC ..... *B65B 11/48* (2013.01); *B65B 13/00* (2013.01); *B65B 23/00* (2013.01); *B65B 49/00* (2013.01); *B65B 55/20* (2013.01); *B65D 5/4266* (2013.01); *B65D 5/5028* (2013.01); *B65D 5/5035* (2013.01); *B65D 65/44* (2013.01); *B65D 77/0413* (2013.01); *B65B 2220/16* (2013.01); *B65D 2585/6887* (2013.01)

(56) References Cited

U.S. PATENT DOCUMENTS

| | | | | |
|---|---|---|---|---|
| 4,360,145 | A | 11/1982 | Wilcox | |
| 4,747,486 | A | 5/1988 | Benno | |
| 4,852,743 | A | 8/1989 | Ridgeway | |
| 4,865,200 | A | 9/1989 | Sullivan et al. | |
| 5,323,896 | A | 6/1994 | Jones | |
| 5,388,701 | A | 2/1995 | Ridgeway | |
| 5,676,245 | A | 10/1997 | Jones | |
| 5,678,695 | A | 10/1997 | Ridgeway et al. | |
| 6,010,006 | A | 1/2000 | Ridgeway et al. | |
| 6,073,761 | A * | 6/2000 | Jones | B65D 5/5028 206/223 |
| 6,158,589 | A | 12/2000 | Smith et al. | |
| 6,913,147 | B2 | 7/2005 | Mueller et al. | |
| 7,731,028 | B2 | 6/2010 | Carroll | |
| 2003/0062286 | A1 | 4/2003 | Igarashi | |
| 2004/0074798 | A1 | 4/2004 | Taylor et al. | |
| 2005/0092645 | A1 * | 5/2005 | Arnold | B65D 81/107 206/523 |
| 2008/0067225 | A1 | 3/2008 | Moore | |
| 2008/0142407 | A1 | 6/2008 | Moore | |
| 2015/0368016 | A1 | 12/2015 | Panzica et al. | |

OTHER PUBLICATIONS

Smart Karton, Solutions by Industry, http://www.smartkarton.com/smart-karton-solutions-by-industry/, as archived by the Wayback Machine on Jan. 8, 2014, 2 pages.

* cited by examiner

METHOD OF PACKAGING A PRODUCT FOR SHIPMENT AND PRODUCT-SHIPPING PACKAGE

The present application is a divisional of U.S. application Ser. No. 14/313,032, filed Jun. 24, 2014; all of which is incorporated herein by reference.

BACKGROUND OF THE INVENTION

The present invention relates to a method of packaging a product for shipment, and a product-shipping package for preparing a product to be shipped in a master container. More particularly, the present invention relates to a method of packaging for shipment both relatively small, non-bulky, lightweight products, as well as relatively large, bulky, heavy products, in a safe manner, and a product-shipping package for preparing such products for shipment.

Product shipping methods, and packages for shipping products, are known. Traditional product shipping methods and packages for shipping products typically involve some variation of placing the product on a corrugated pad, and then either sealing the product to the corrugated pad with strapping, a plastic sheet, or a sheet of bubble wrap, or else inserting the product into an open plastic envelope pre-attached to the corrugated pad, and sealing shut the plastic envelope. The sealed products and the pad are then placed in a master container to be shipped, sometimes with additional protection added in the form of additional sheets of plastic, additional sheets of bubble wrap, sheets of paper, or foam "packing peanuts." The traditional shipping methods and packages are adequate for packaging and shipping relatively small, non-bulky, and lightweight products, such as books, video discs, compact discs, cellular phones, electronic notebooks, sporting goods, small personal and household items, children's toys, and the like. Attempting to package and ship relatively large, bulky, or heavyweight products, such as automobile doors, automobile body components, vehicle windshields, and other relatively large commercial products, with traditional shipping methods and packages, however, often results in the product becoming loose and shifting within the master shipping container, or portions of the product coming into contact with inner wall surfaces of the master container; situations which may result in damage to the product.

SUMMARY OF THE INVENTION

It is an object of the present invention to provide a method and an apparatus for shipping a range of products, including relatively small, non-bulky, and lightweight products, as well as relatively large, bulky, and heavyweight products, efficiently and safely.

As broadly embodied herein, a method and apparatus for packaging a product comprises: utilizing a generally rectangular pad having dimensions selected according to dimensions of the product, the pad comprising upper and lower edges and right and left edges, a central portion, upper and lower portions, and right and left portions, the upper and lower portions being defined by at least one pair of horizontal score lines inset from the upper and lower edges, respectively, the right and left portions being defined by a pair of vertical score lines inset from the right and left edges, respectively, and a plurality of spaced die-cut tabs defined in the vertical score lines, each of the die-cut tabs including two die-cut slots and a die-cut edge connecting the die-cut slots.

As further broadly embodied herein, the product is placed on the central portion of the pad; at least one of the upper and lower portions is folded toward the product. In one embodiment the at least one of the upper and lower portions is folded prior to placing the product on the central portion, so that a portion of the product rests on top of the folded-over at least one of the upper and lower portions. In another embodiment the at least one of the upper and lower portions is folded after the product is placed on the central portion, so that the at least one of the upper and lower portions contacts the product. At least one turn of restraining material, for example, plastic sheeting, or strapping, is wrapped around the central portion of said pad, and the product.

As further broadly embodied herein, the right and left portions are folded in the direction toward the product to an upright position substantially perpendicular to the pad, the folding separating the die-cut tabs from the central portion with the die-cut edges extending to an extended position, below the central portion, substantially aligned with one another, and substantially perpendicular to the pad. As further broadly embodied herein, the wrapped product and pad are inserted into a master container for shipping. The at least one turn of restraining material wrapped around the central portion and the product resists movement of the product relative to the pad and the master container, while the right and left portions in the upright position cooperate with the die-cut edges in the extended position to suspend the pad and the product within the master container.

As further broadly embodied herein, in another embodiment, the at least one pair of score lines are vertical score lines defined inset from the right and left edges, and the pair of score lines with the plurality of spaced die-cut tabs are horizontal score lines defined inset from the upper and lower edges. In this embodiment, the product is placed on the central portion, and at least one of the right and left edges is folded toward the central portion. The product and the central portion are wrapped with at least one turn of restraining material. The upper and lower portions are folded toward the product to the upright position substantially perpendicular to the central portion with the die-cut edges extending to the aligned, substantially parallel extended position below the pad. The wrapped product and pad are inserted into a master container for shipping, with the at least one turn of restraining material wrapped around the pad, and the product resisting movement of the product relative to the pad and the master container, while the upper and lower portions in the upright position cooperate with the aligned die-cut edges in the extended position to suspend the pad and the product within the master container.

These and other objects of the present invention will be apparent from review of the following specification and the accompanying drawings.

DETAILED DESCRIPTION OF THE PREFERRED EMBODIMENTS

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

Figure 1A:
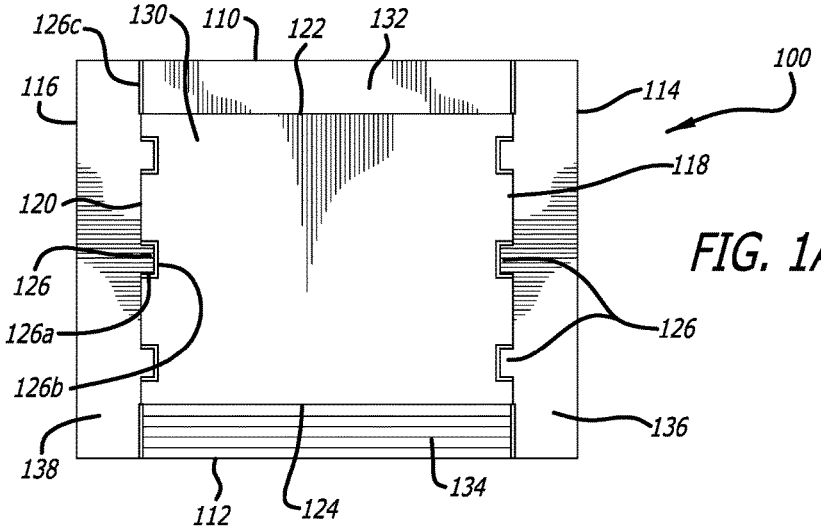
FIG. 1A is a top view of a generally rectangular corrugated pad in accordance with the present invention, depicting parallel horizontal score lines in a lower portion of the pad, and die-cut portions defined in parallel vertical score lines.
Figure 1B:
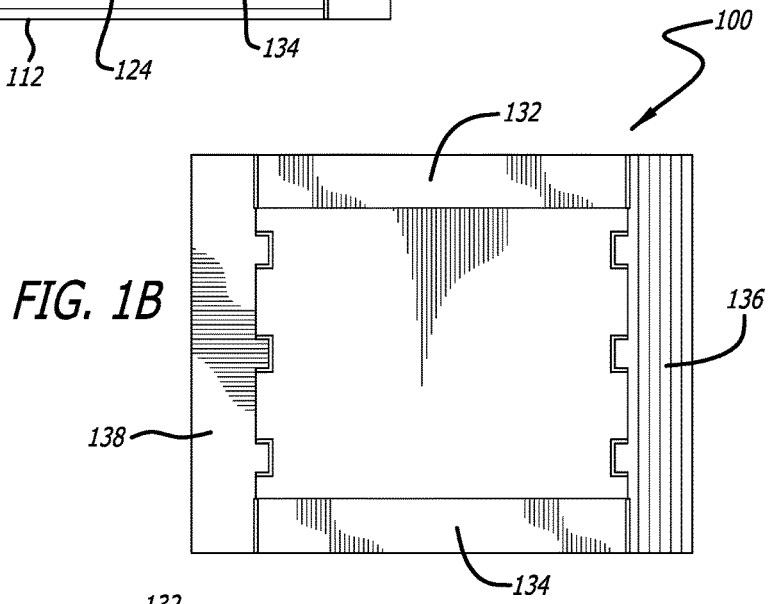
FIG. 1B is a top view of a generally rectangular corrugated pad in accordance with the present invention, depicting parallel vertical score lines in a right portion of the pad, and die-cut portions defined in parallel vertical score lines.
Figure 1C:
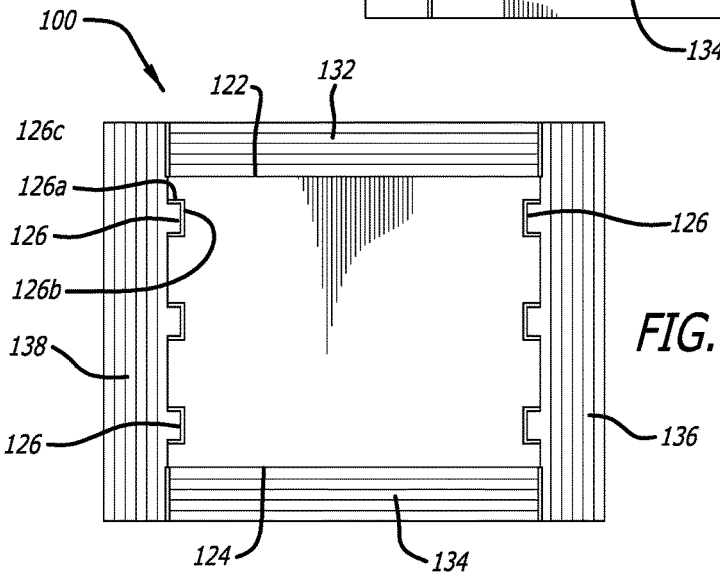
FIG. 1C is a top view of a generally rectangular corrugated pad in accordance with the present invention, depicting horizontal and vertical score lines in upper, lower, right, and left portions of the pad, die-cut portions defined in parallel vertical score lines.
Figure 2A:
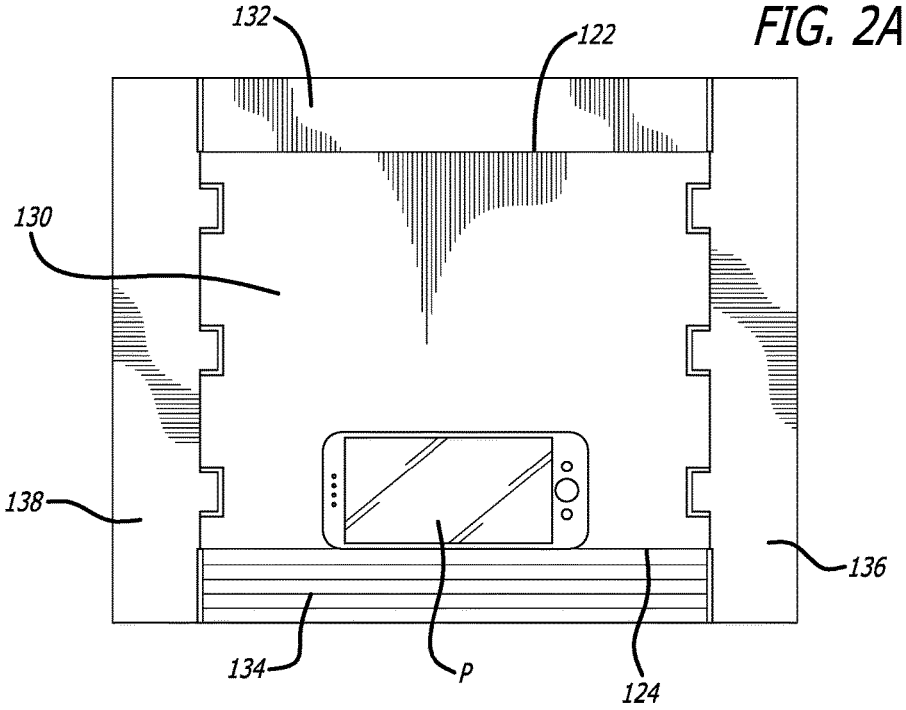
FIG. 2A is a top view of the embodiment of FIG. 1A, with a relatively small, non-bulky, lightweight product placed in the central portion of the pad.
Figure 2B:
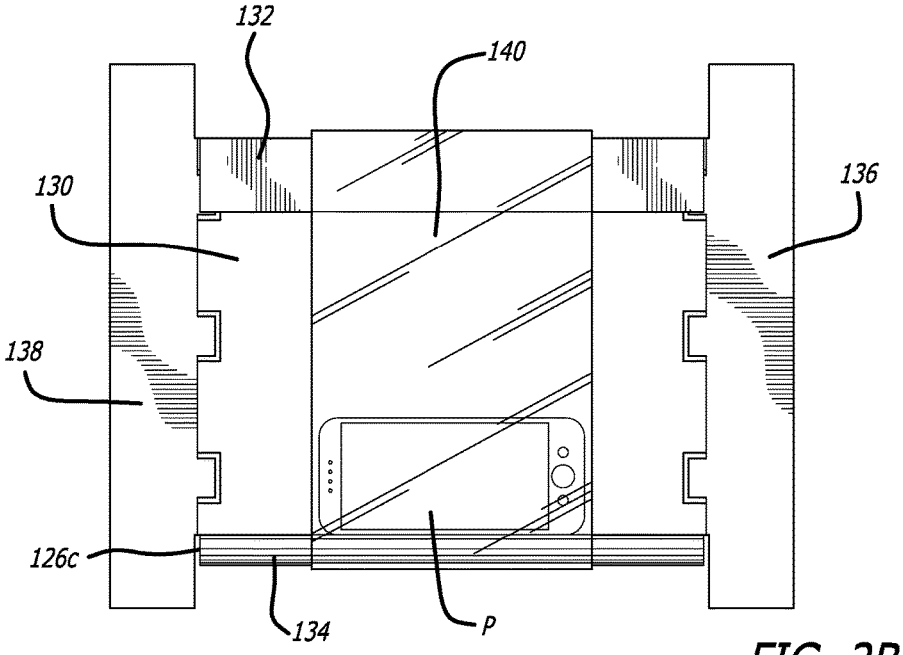
FIG. 2B is a top view of the embodiment of FIG. 2A, with the bottom portion folded up toward the product, and at least one wrap of restraining material, in the form of plastic sheeting, wrapped around the central portion and the product.
Figure 2C:
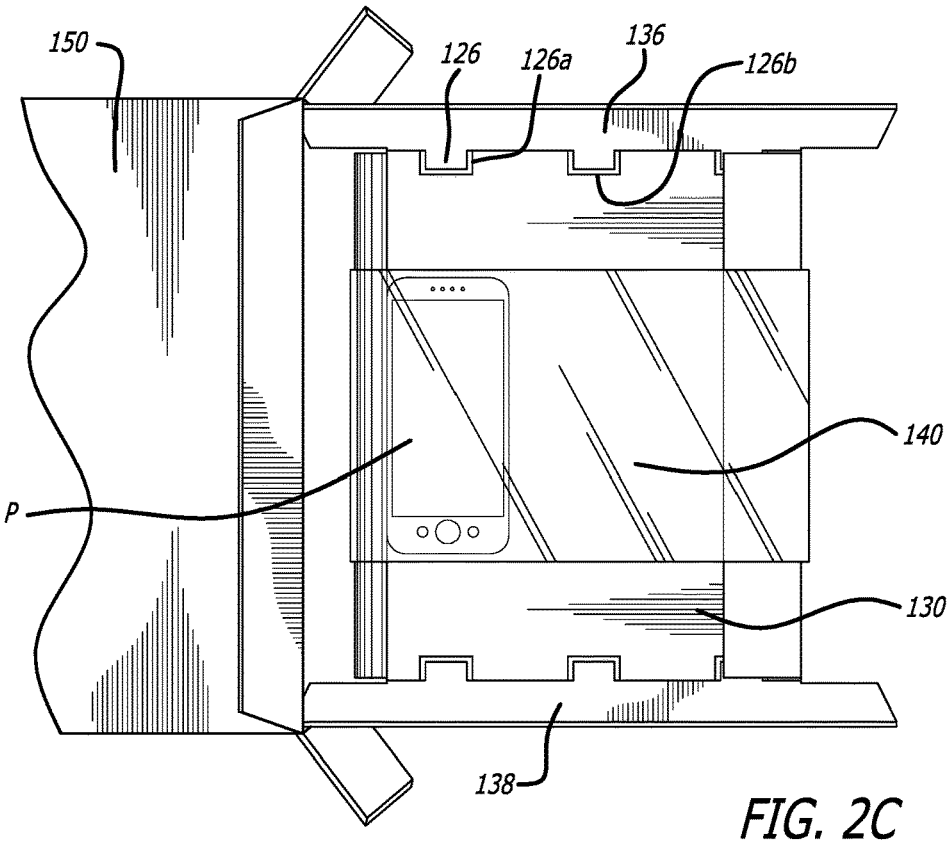
FIGS. 2C and 2D are a top view and a front view, respectively, of the embodiment of FIG. 2B, with the relatively small, non-bulky, lightweight product placed in the central portion, and the right and left portions folded upward to an upright position substantially perpendicular to the central portion, and the die-cut tabs separated from the central portion, with the die-cut edges extended to the aligned extended position below the central portion, and substantially perpendicular to the central portion, and the wrapped product and pad being inserted into a master shipping container.
Figure 2D:
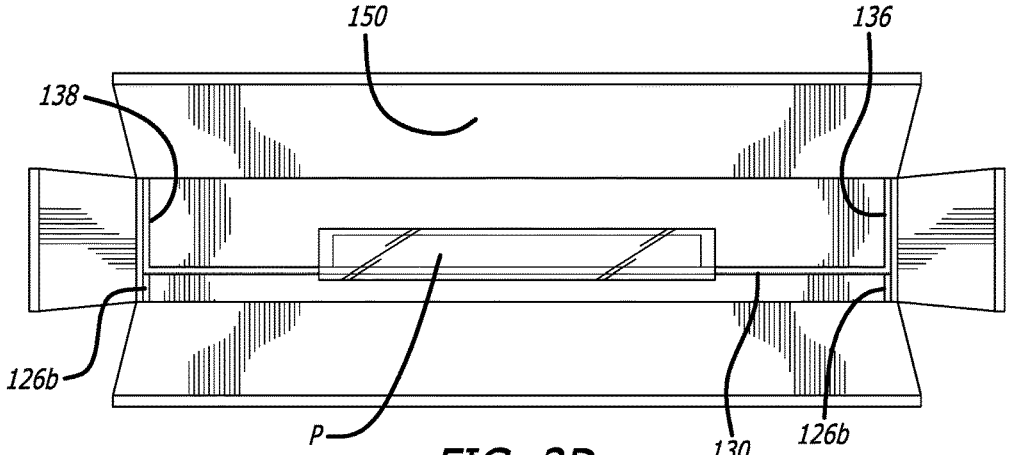
Figure 3A:
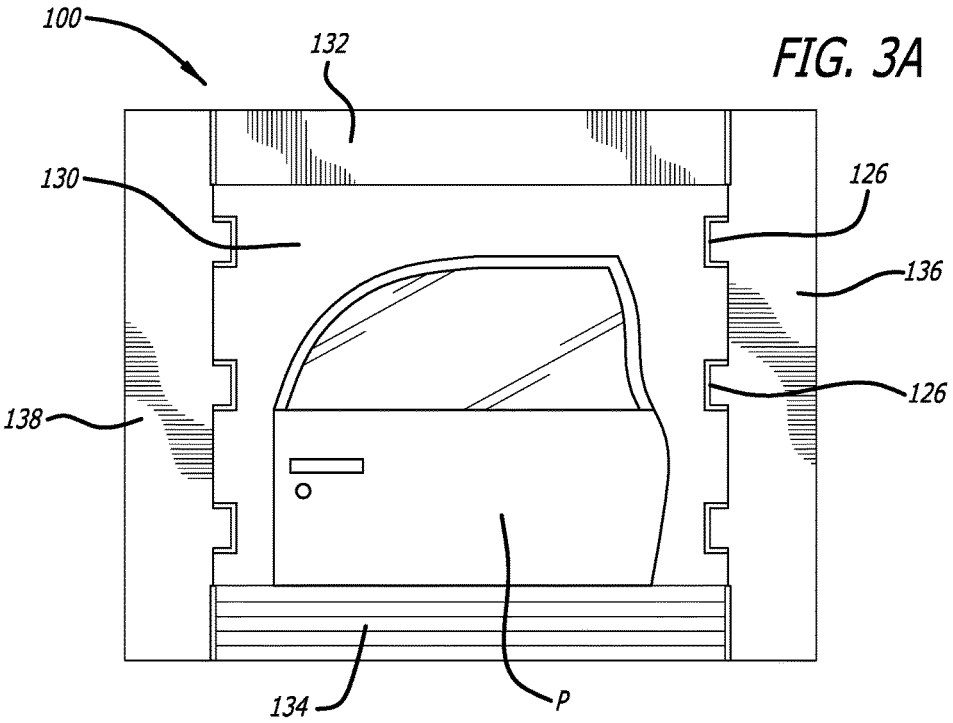
FIG. 3A is a top view of the generally rectangular corrugated pad in accordance with the present invention, depicting horizontal and vertical score lines in upper, lower, right, and left portions of the pad, die-cut portions defined in parallel vertical score lines, and a relatively large, bulky heavyweight product placed on the central portion of the pad.
Figure 3B:
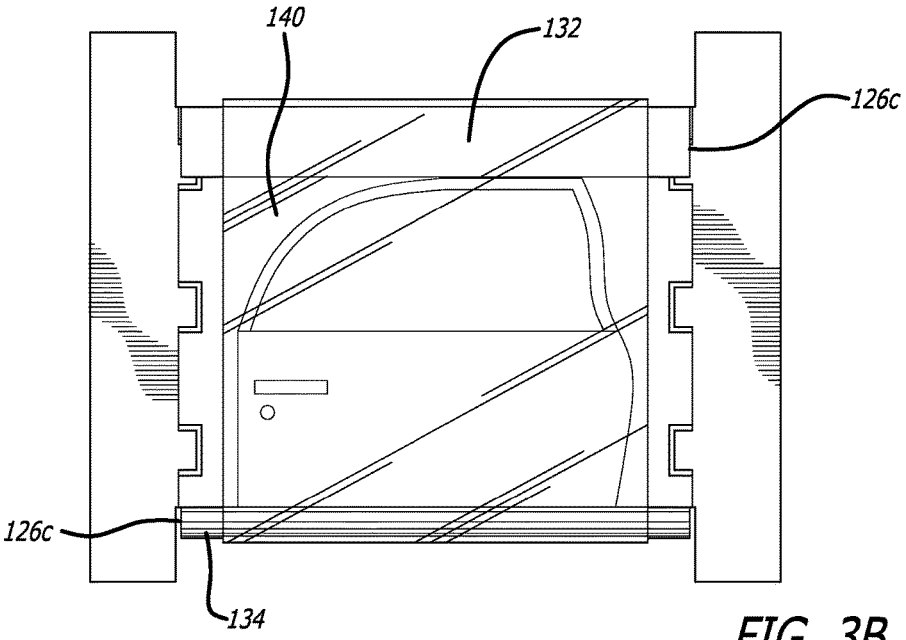
FIG. 3B is a top view of the embodiment of FIG. 3A, with upper and lower portions folded toward the product, and at least one wrap of restraining material, in the form of plastic sheeting, wrapped around the central portion, the product, and the folded-over upper and lower portions.
Figure 3C:
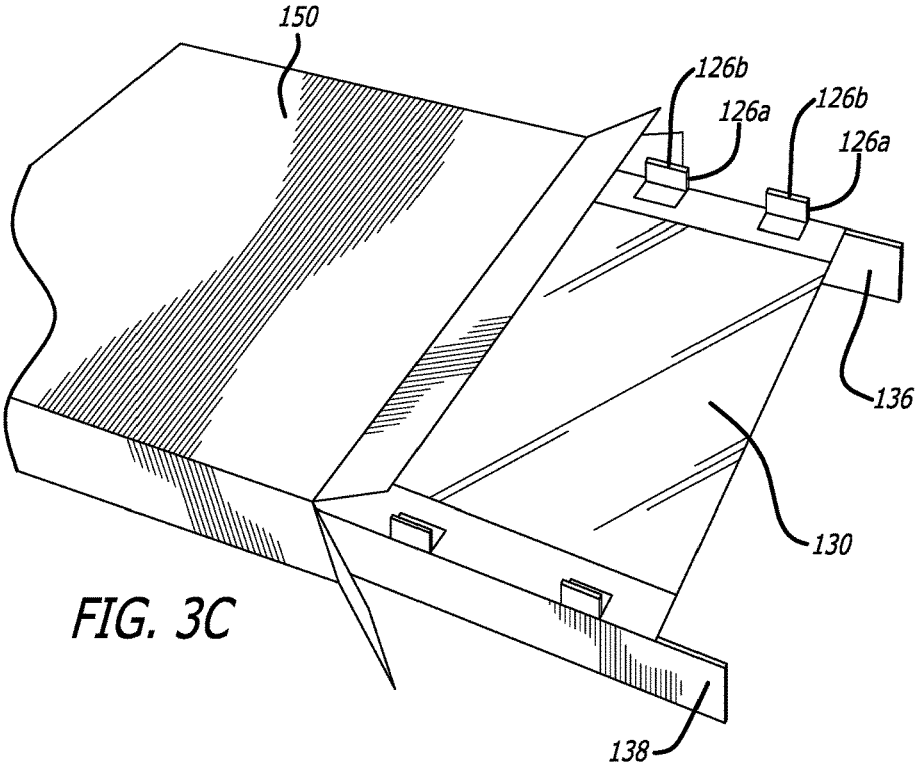
FIGS. 3C and 3D are bottom perspective views, of the embodiments of FIGS. 2C and 2D, respectively, depicting the relatively large, bulky, heavyweight product packaged and wrapped for shipment in accordance with the invention, with the right and left portions folded upward to an upright position substantially perpendicular to the central portion, and the die-cut tabs separated from the central portion, the die-cut edges being extended to the aligned extended position below the central portion, and substantially perpendicular to the central portion, and the wrapped product and pad being inserted into a master shipping container.
Figure 3D:
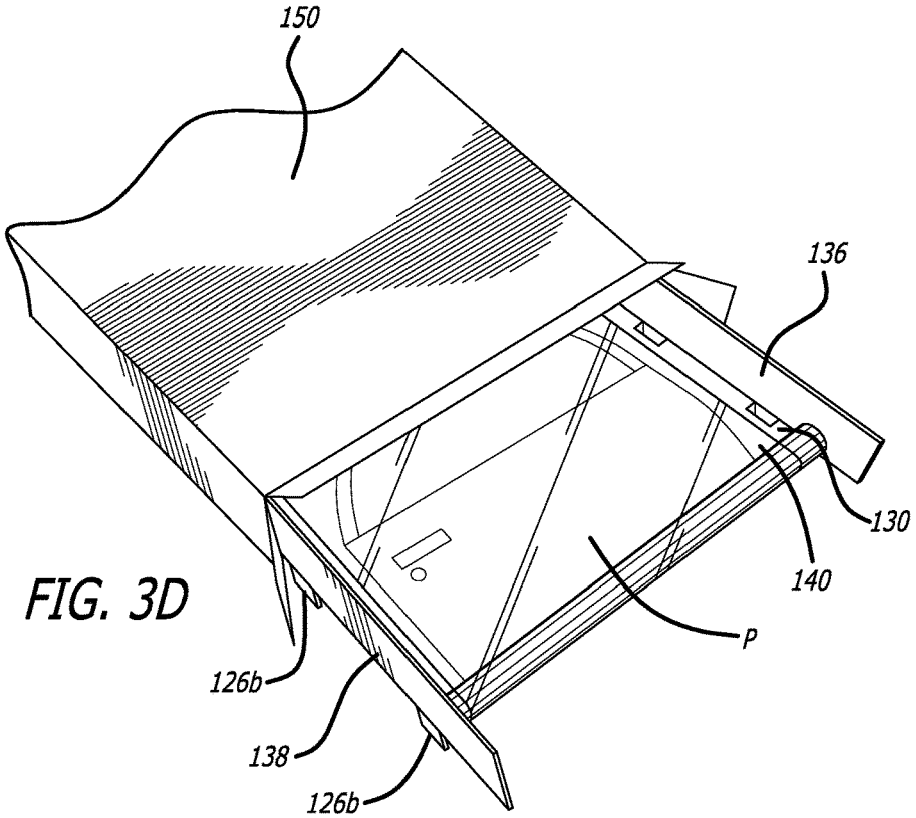
Figure 4A:
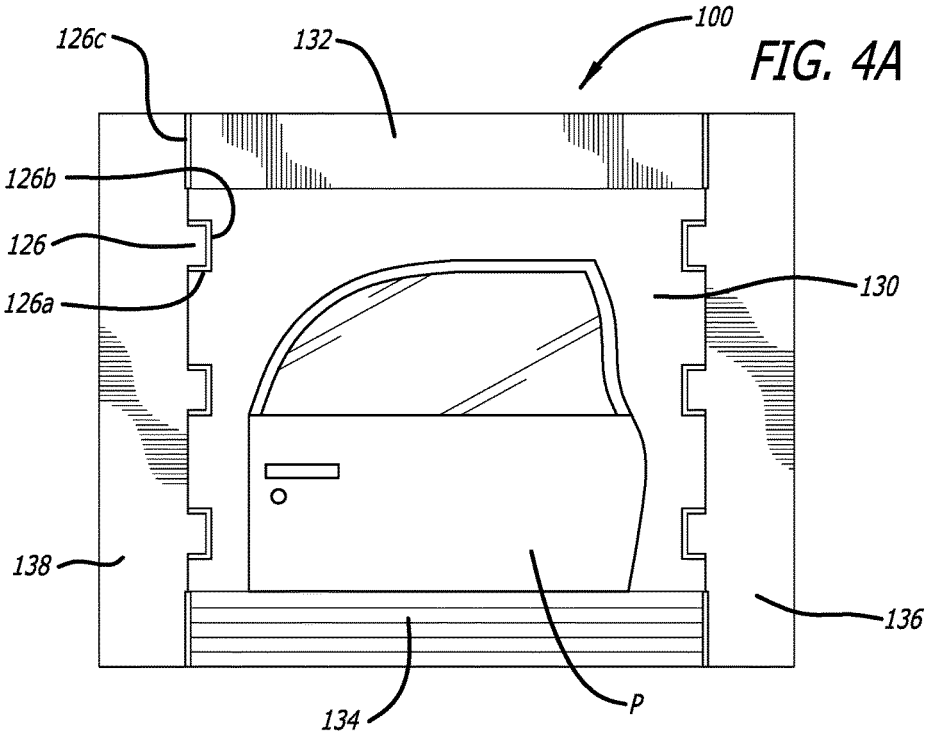
FIG. 4A is a top view similar to the embodiment of FIG. 3A.
Figure 4B:
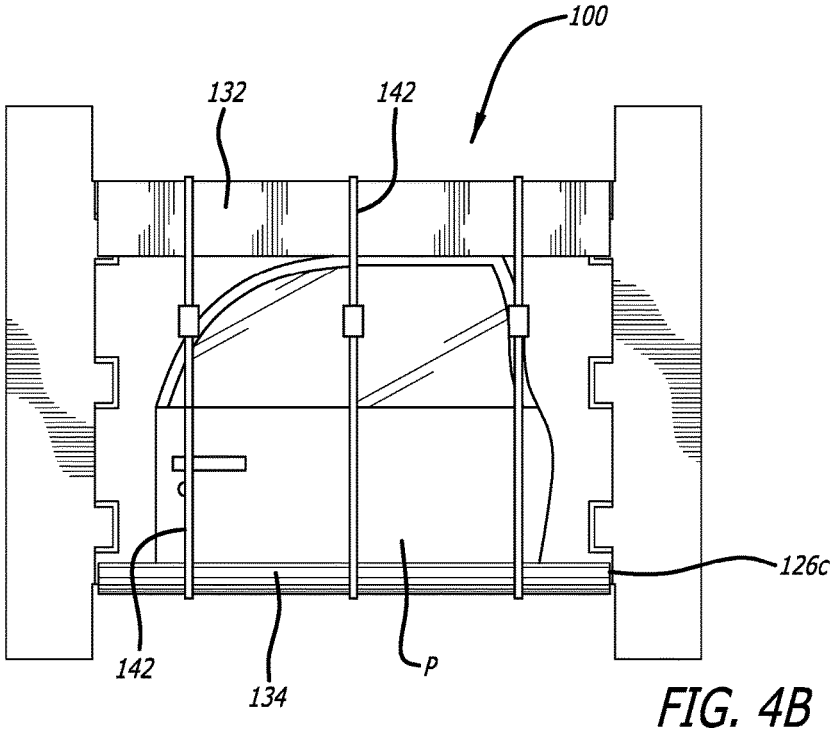
FIG. 4B is a top view of another embodiment of the present invention, similar to the embodiment of FIG. 3B, with the bottom portion folded up toward the product, but the at least one wrap of restraining material wrapped around the central portion and the product is strapping instead of plastic wrapping.

A method for packaging a product, in accordance with the present preferred embodiments, and with reference to FIGS. 1A-1C, comprises utilizing a die-cut, and scored pad 100. Die-cut and scored pad 100 is preferably a planar corrugated cardboard pad, but is not limited to this configuration. For example, but not by way of limitation, a chip board or a corrugated plastic pad could be used as the die-cut, scored pad 100. Other materials also would fall within the scope of the present invention. As broadly embodied in FIGS. 1A-1C, corrugated pad 100 is generally rectangular in shape, and includes upper and lower edges 110 and 112, and right and left edges 114 and 116. An example of a pad 100, as embodied in FIGS. 1A-1C, dimensions for the pad 100 include a length L of approximately 81.75 inches, and a width W of approximately 65.7593 inches; the actual dimensions of pad 100, as used in accordance with the invention, however, will vary depending on the dimensions of the product being packaged and shipped.

A right vertical score line 118 is provided inset from the right edge 114, and a left vertical score line 120 is provided inset from the left edge 116. As embodied in FIG. 1A, vertical score lines 118 and 120 are preferably substantially parallel with respect to one another. An upper horizontal score line 122 is provided inset from the upper edge 110, and a lower horizontal score line 124 is provided inset from the lower edge 112. As embodied in FIGS. 1A-1C, horizontal score lines 122 and 124 are preferably substantially parallel to one another, and are preferably substantially perpendicular to right and left vertical score lines 118 and 120, respectively. In addition, the number of right and left vertical score lines, and the number of upper and lower horizontal score lines can vary, depending on the product to be packaged and shipped.

As embodied in FIGS. 1A-1C, vertical score lines 118 and 120 include a plurality of die-cut tabs 126 provided at spaced-apart positions along the length of the right and left vertical score lines 118 and 120. Each of the die-cut tabs 126 include two preferably parallel die-cut slots 126*a* and a die-cut edge 126*b* connecting the two die-cut slots 126*a*. In addition, die-cut slots 126*c* are provided extending inward from the upper and lower edges 110 and 112.

The various score lines 118, 120, 122, and 124 described above and depicted in FIG. 11, also define portions of the corrugated pad 100, including a central portion 130, an upper portion 132, a lower portion 134, a right portion 136, and a left portion section 138. An example of the upper and lower portions, and the right and left portions, is embodied in FIGS. 1A-1C. The upper and lower portions 130 and 132 each measure approximately 12 inches by 63.75 inches, and the right and left portions 134 and 136 each measure approximately 11.5 inches by 58.75 inches. The actual dimensions, however, in accordance with the present invention, will vary depending on the dimensions of the product to be packaged and shipped.

The upper portion 132 and the lower portion 134 are configured to fold inward along their respective die-cut score lines 122 and 124 in a first direction, and along die-cut slots 126*c* toward the central section 130, as depicted in FIGS. 3A-3B, 4A-4B, and 5C-5D. When the upper and lower sections 132 and 134 fold inward, corrugated pad 100 separates along the die-cut score lines 126*c*.

As embodied in FIGS. 2A-2D, 3A-3D, and 4A-4D, the shipping method and package of the present invention can be used to ship any size product P, from a relatively small, non-bulky, lightweight product, such as a mobile phone depicted in FIGS. 2A-2D, to a relatively large, bulky, heavyweight product such as an automobile door depicted in FIGS. 3A-3D and 4A-4D.

As embodied in FIGS. 2A-2D and 3A-3D, upper and lower portions 132 and 134 are folded toward the central section 130, and into contact with a portion or portions of the product P proximate the nearest respective score line.

After the upper and lower portions 132 and 134 have been folded, and the product P placed on the central portion 130, the pad and the product are placed on a conveyer belt leading into an automated wrapping tunnel (not shown). In a preferred embodiment, the pad 100 and the product P will move linearly through the automated wrapping tunnel on the conveyer belt. As embodied in FIGS. 2B, 2C, 3B, and 3D, at least one turn of pre-tensioned restraining material is wrapped around the pad 100 and the product P in a top to bottom orientation, enveloping the door. The amount of pressure applied to the folded-over upper and lower portions 132 and 134 by the restraining material preferably falls within a range of 10 psi through 25 psi, and most preferably 20 psi. In the embodiments of FIGS. 2B, 2C, 3B, and 3D, the restraining material is a plastic sheet wrap 140. When plastic sheet wrap 140 is used as the restraining material, the preferred plastic sheet wrap is 80 gauge pre-stretched film, capable of withstanding at least 20 lbs, of tension, used to work with loads weighing up to 2200 lbs. The number of turns of plastic sheet wrap 140 is determined based on the dimensions of the product P to be packaged and shipped. In certain packaging applications depicted in FIGS. 4A-4B, for example when a large volume of products P are to be packaged and shipped, it may be more cost effective, and within the scope of the invention, to use strapping 142 as the restraining material, in place of the more expensive plastic sheet wrap.

After the wrapping, the right and left portions 136 and 138 are folded along their respective score lines, toward the product P until they reach an upright position perpendicular to the central portion 130, as shown in FIGS. 2C-2D and 3C-3D. In the perpendicular position, the right and left portions 136 and 138 will contribute to suspension of the pad 100 and the product P, when they are inserted into a master shipping container 150, as discussed below.

When the right and left portions 136 and 138 fold upward to the perpendicular position, the die-cut tabs 126 will separate from the central portion 130. As embodied in FIGS. 2D, 3C, and 3D, when the die-cut tabs separate from the central portion 130, the die cut edges 126*b* extend to an extended position below the central portion 130, perpendicular to the central portion 130, and aligned with one another.

The wrapped central portion 130 and product P are inserted into the master shipping container 150. As embodied in FIGS. 2C-2D and 3C-3D, the restraining material wrapped around the central portion 130 and the product P resists movement of the product P with respect to the pad 100, while the upright right and left sides 114 and 116 cooperate with the extended aligned die-cut tab edges 126*b* to suspend product P within the master container 150, both to prevent movement, and to prevent portions of the product P from contacting inner surfaces of the master container 150.

Once the corrugated pad 100 and the product P are inserted fully into the master shipping container 150, the outer flaps are shut and sealed, and the master container 150 is ready to be shipped.

Figure 5A:
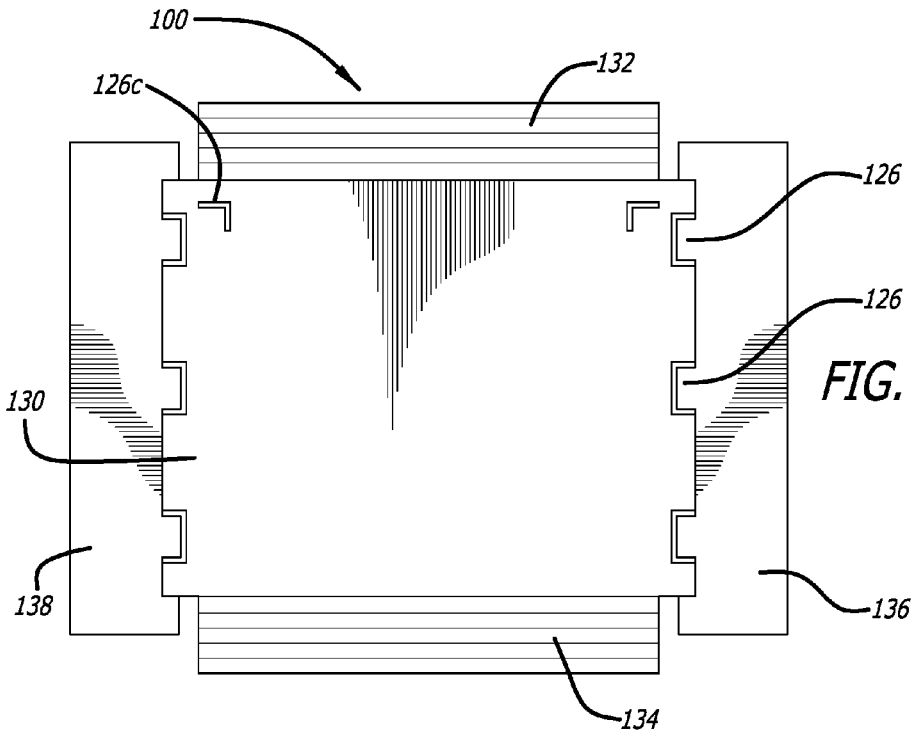
FIGS. 5A and 5B are top and perspective views, respectively, of another embodiment of the present invention, wherein the upper portion of the pad is folded toward the central portion before the product is placed on the central portion.
Figure 5B:
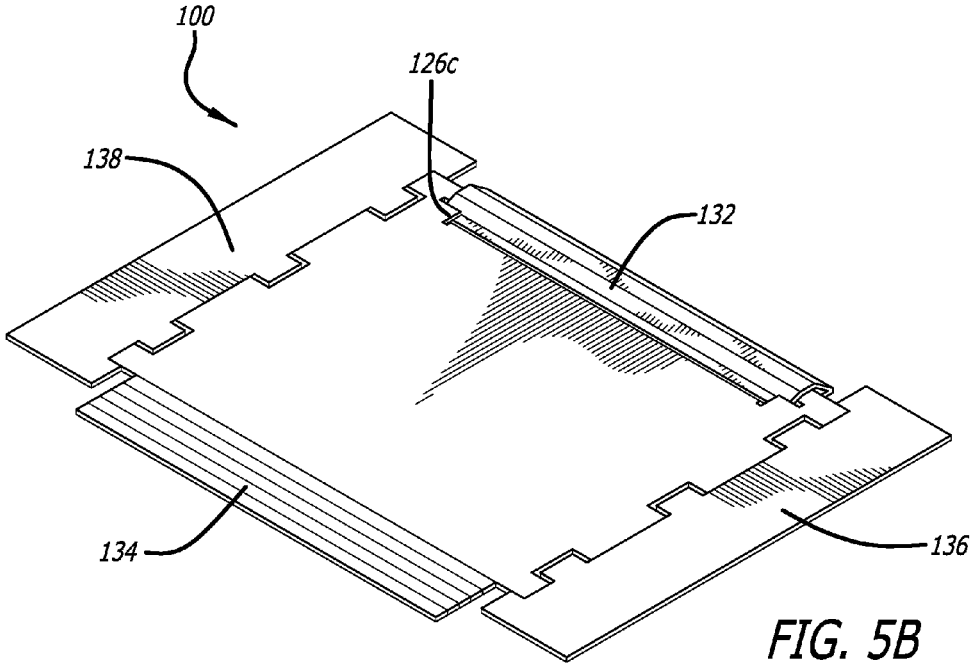
Figure 5C:
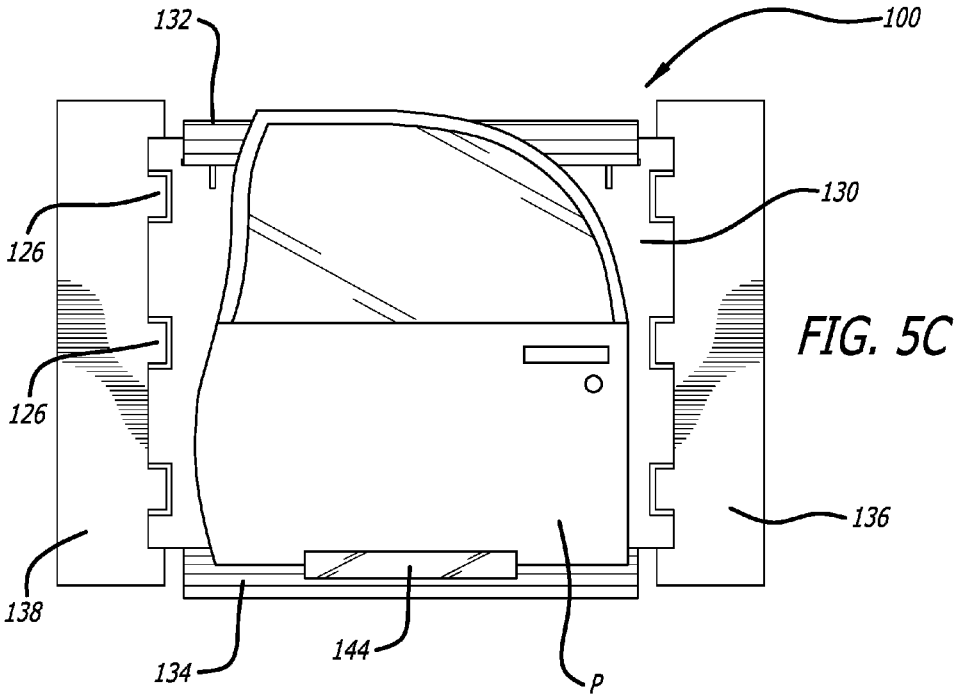
FIG. 5C is a top view of the embodiment depicted in FIG. 5B, with a relatively large, bulky, and heavyweight product placed on the central portion of the pad, with a portion of the product resting on the folded over upper portion, and the lower portion folded up into contact with the product and secured to the product with an adhesive.
Figure 5D:
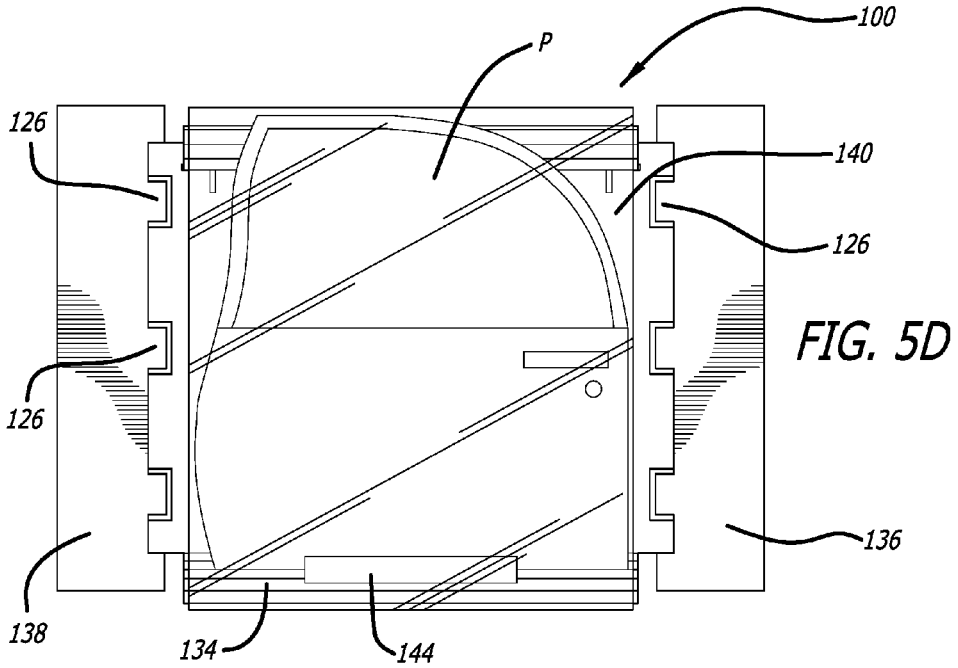
FIG. 5D is a top view of the embodiment of FIG. 5C with at least one turn of restraining material, in the form of plastic sheeting, wrapped around the pad and the product.

FIGS. 5A-5D depict another embodiment of the invention, substantially identical to the embodiments of FIGS. 1A-4D, except that one of the upper and lower portions 132 and 134, upper portion 132 as embodied in FIG. 5B is folded inward, into die-cut slot 126*c* before the product P id placed on the central portion 130, as embodied in FIG. 5C, with a portion P1 of the product P resting on the folded-in upper portion 132. As embodied in FIG. 5D, the lower portion 132 is next folded inward into contact with product P, and secured into contact, preferably with an adhesive 144. The restraining material, plastic sheet wrap in FIG. 5D, is wrapped around the central portion 130 and the product P. The remainder of the packaging and shipping steps are identical to those described above with respect to FIGS. 1A-4D. The embodiment of FIGS. 5A-5D is most suitable for use when packaging and shipping certain products P. For example, although an automobile door is depicted in FIGS. 5A-5D, this embodiment is particularly well-suited for packaging and shipping a vehicle windshield or the like.

The invention has been described with respect to the die-cut portions being defined in the right and left vertical score lines, the upper and lower portions being folded into contact with the product P on the central portion and wrapped, and the right and left portions being folded upward to the vertical position perpendicular to the central portion, in order to, with the die-cut tab edges, hold the product suspended within the master container. The pad also could be oriented such that the die-cut portions are defined in the upper and lower horizontal score lines, the right and left portions are folded over into contact with the product P and wrapped with the restraining material oriented in a side to side orientation, and the upper and lower portions are folded to the upright position perpendicular to the central portion, in order to cooperate with the perpendicular aligned die-cut tab edges to suspend the product within the master container.

The invention has been described with the wrapping being performed by an automated process. Other or all of the steps in the disclosed process of packaging the product for shipping could be performed using automated machinery and still fall within the scope of the present invention.

What is claimed is:

1. A packaging system for products to be shipped in a master container, the packaging system comprising:

a product;

a generally planar pad having dimensions selected according to dimensions of the product, said pad being foldable at least in part and comprising:

upper and lower edges and right and left edges, a central portion configured to have the product placed thereon, upper and lower portions, each of said upper and lower portions defined by at least one pair of horizontal score lines inset from said upper and lower edges, respectively, right and left portions defined by a pair of vertical score lines inset from said right and left edges, respectively, and a plurality of spaced die-cut tabs defined in said pair of vertical score lines, each of said die-cut tabs including two die-cut slots and a die-cut edge connecting said die-cut slots;

at least one of said upper and lower portions being configured to be foldable toward said central portion, and into contact with the product, said at least one of said upper and lower portions being folded along at least one of said horizontal score lines and contacting the product proximate at least one of said upper and lower edges of said pad;

a flexible restraining material configured to be wrapped around at least a portion of said pad;

said central portion, the product, and said at least one of said upper and lower portions when folded contacting the product, and being encircled with at least one turn of the restraining material wrapped around said central portion, the product, and said one of said upper and lower portions contacting the product, the restraining material restraining the product to resist movement relative to said central portion and said one of said upper and lower portions contacting the product;

said right and left portions being folded toward said central portion, to an upright position substantially normal to said central portion, and wherein said die-cut tabs separate from said central portion with said die-cut edges extending to an extended position below and substantially normal to said central portion; and wherein said central portion, the product, and the at least one wrap of restraining material is adapted to be inserted into the master container for shipping.

2. The system of claim 1, wherein said right and left portions in the upright position and said die-cut edges in the extended position are adapted to cooperate to suspend said central portion and the product within the master container.

3. The system of claim 1, wherein said die-cut edges in the extended position are aligned with one another.

4. A packaging system for products to be shipped in a master container, the packaging system comprising:

a product;

a generally planar pad having dimensions selected according to dimensions of the product, said pad being foldable at least in part and comprising:

upper and lower edges and right and left edges, a central portion configured to have the product placed thereon, right and left portions defined by at least one pair of vertical score lines inset from said right and left edges, respectively, upper and lower portions defined by at least one pair of horizontal score lines inset from said upper and lower edges, respectively, and a plurality of spaced die-cut tabs defined in said pair of generally parallel horizontal score lines, each of said die-cut tabs including two die cut slots and a die-cut edge connecting said two die-cut slots;

at least one of said right and left portions being configured to be foldable toward said central portion, and into contact with the product, said at least one of said right and left portions being folded along at least one of said vertical score lines and contacting the product proximate at least one of said right and left edges of said pad;

a flexible restraining material configured to be wrapped around at least a portion of said pad;

said central portion, the product, and said at least one of said right and left portions when folded contacting the product, and being encircled with at least one turn of the restraining material wrapped around said central portion, the product, and said one of said right and left portions contacting the product, the restraining material restraining the product to resist movement relative to said central portion and said one of said right and left portions contacting the product;

said upper and lower portions being folded toward said central portion, to an upright position substantially normal to said central portion, and wherein said die-cut tabs separate from said central portion with said die-cut edges extending to an extended position below and substantially normal to said central portion; and wherein said central portion, the product, and the at least one wrap of restraining material is adapted to be inserted into the master container for shipping.

5. The system of claim 4, wherein said upper and lower portions in the upright position and said die-cut edges in the extended position are adapted to cooperate to suspend said central portion and the product within the master container.

6. The system of claim 4, wherein said die-cut edges in the extended position are aligned with one another.

7. A packaging system for products to be shipped in a master container, the packaging system comprising:

a product;

a generally planar pad having dimensions selected according to dimensions of the product, said pad being foldable at least in part and comprising:

upper and lower edges and right and left edges, a central portion configured to have the product placed thereon, upper and lower portions, each of said upper and lower portions defined by at least one pair of horizontal score lines inset from said upper and lower edges, respectively, right and left portions defined by a pair of vertical score lines inset from said right and left edges, respectively, and a plurality of spaced die-cut tabs defined in said pair of vertical score lines, each of said die-cut tabs including two die-cut slots and a die-cut edge connecting said die-cut slots;

at least one of said upper and lower portions being configured to be foldable toward said central portion, and into contact with the product, said at least one of said upper and lower portions being folded along at least one of said horizontal score lines and contacting the product proximate at least one of said upper and lower edges of said pad, when said upper portion and said lower portion are folded toward said central portion, said upper and lower edges of said upper and lower portions, respectively, extending substantially across said central portion between said left and right portions;

a flexible strapping material configured to be wrapped around at least a portion of said pad;

said central portion, the product, and said at least one of said upper and lower portions when folded contacting the product, and being encircled with at least one turn of the strapping material wrapped around said central portion, the product, and said one of said upper and lower portions contacting the product, the strapping material restraining the product to resist movement relative to said central portion and said one of said upper and lower portions contacting the product;

said right and left portions being adapted to fold toward said central portion, to an upright position substantially normal to said central portion, and wherein said die-cut tabs separate from said central portion with said die-cut edges extending to an extended position below and substantially normal to said central portion; and wherein said central portion, the product, and the at least one wrap of strapping material is adapted to be inserted into the master container for shipping.

8. The system of claim 7, wherein said right and left portions in the upright position and said die-cut edges in the extended position are adapted to cooperate to suspend said central portion and the product within the master container.

9. The system of claim 7, wherein said die-cut edges in the extended position are aligned with one another.

* * * * *